US006952146B2

(12) United States Patent
Brown et al.

(10) Patent No.: US 6,952,146 B2
(45) Date of Patent: Oct. 4, 2005

(54) VARIABLE FLUIDIC WAVEGUIDE ATTENUATOR

(75) Inventors: Stephen B. Brown, Palm Bay, FL (US); James J. Rawnick, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 140 days.

(21) Appl. No.: 10/624,378

(22) Filed: Jul. 22, 2003

(65) Prior Publication Data

US 2005/0017819 A1 Jan. 27, 2005

(51) Int. Cl.[7] ..... H01P 1/22
(52) U.S. Cl. ..... 333/81 B; 333/209
(58) Field of Search ..... 333/81 R, 81 B, 333/208, 209, 211

(56) References Cited

U.S. PATENT DOCUMENTS

| | | | | |
|---|---|---|---|---|
| 3,701,058 A | | 10/1972 | Smith | |
| 4,604,592 A | * | 8/1986 | Pinson | 333/24.1 |
| 5,162,972 A | | 11/1992 | Gripshover et al. | |
| 5,792,236 A | | 8/1998 | Taylor et al. | |
| 6,515,235 B2 | | 2/2003 | Moller | |
| 6,743,371 B2 | * | 6/2004 | John et al. | 252/62.52 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.

(Continued)

*Primary Examiner*—Stephen E. Jones
(74) *Attorney, Agent, or Firm*—Sacco & Associates, PA

(57) ABSTRACT

A waveguide attenuator apparatus (100) includes a variable waveguide attenuator (102) having at least one waveguide attenuator cavity (109) and a fluidic dielectric (108) having a loss tangent, a permittivity and a permeability at least partially disposed within the waveguide attenuator cavity. At least one composition processor (101) is included and adapted for dynamically changing a composition or volume of the fluidic dielectric to vary the loss tangent, the permittivity and/or the permeability. A controller (136) is provided for controlling the composition processor to selectively vary the loss tangent, the permittivity and/or the permeability in response to a waveguide attenuator control signal (137). In one arrangement, the permittivity and permeability can be varied concurrently.

32 Claims, 4 Drawing Sheets

OTHER PUBLICATIONS

U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.

* cited by examiner

VARIABLE FLUIDIC WAVEGUIDE ATTENUATOR

BACKGROUND OF THE INVENTION

1. Statement of the Technical Field

The inventive arrangements relate generally to methods and apparatus for providing increased design flexibility for RF circuits, and more particularly to a waveguide attenuator.

2. Description of the Related Art

A waveguide typically includes a material medium that confines and guides a propagating electromagnetic wave. In the microwave regime, a waveguide normally consists of a hollow metallic conductor, usually rectangular, elliptical, or circular in cross section. This type of waveguide may, under certain conditions, contain a solid or gaseous dielectric material.

In a waveguide or cavity, a "mode" is one of the various possible patterns of propagating or standing electromagnetic fields. Each mode is characterized by frequency, polarization, electric field strength, and magnetic field strength. The electromagnetic field pattern of a mode depends on the frequency, refractive indices or dielectric constants, and waveguide or cavity geometry.

An "evanescent field" in a waveguide is a time-varying field having an amplitude that decreases monotonically as a function of transverse radial distance from the waveguide, but without an accompanying phase shift. The evanescent field is coupled, i.e., bound, to an electromagnetic wave or mode propagating inside the waveguide.

Variable waveguide attenuators are commonly used to attenuate microwave signals propagating within a waveguide, which is a type of transmission line structure commonly used for microwave signals. Waveguides typically consist of a hollow tube made of an electrically conductive material, for example copper, brass, steel, etc. Further, waveguides can be provided in a variety of shapes, but most as previously mentioned often are cylindrical or have a rectangular cross section. In operation, waveguides propagate modes above a certain cutoff frequency.

Waveguide attenuators are available in a variety of arrangements. In one arrangement, the waveguide attenuator consists of three sections of waveguide in tandem: a middle section and two end sections. In each section a resistive film is placed across an inner diameter of the waveguide (in the case of a waveguide having a circular cross section) or across a width of the waveguide (in the case of a waveguide having a rectangular cross section). In either case, the resistive film collinearly extends the length of each waveguide section. The middle section of the waveguide is free to rotate radially with respect to the waveguide end sections. When the resistive film in the three sections are aligned, the E-field of the an applied microwave signal is normal to all films. When this occurs, no current flows in the films and no attenuation occurs. When the center section is rotated at an angle $\theta$ with respect to the end section at the input of the waveguide, the E field can be considered to split into two orthogonal components, $E \sin \theta$ and $E \cos \theta$. $E \sin \theta$ is in the plane of the film and $E \cos \theta$ is orthogonal to the film. Accordingly, the $E \sin \theta$ component is absorbed by the film and the $E \cos \theta$ component is passed unattenuated to the end section at the output of the waveguide. The resistive film in the end section at the output then absorbs the $E \cos \theta \sin \theta$ component of the E field and an $E \cos^2 \theta$ component emerges from the waveguide at the same orientation as the original wave. The accuracy of such an attenuator is dependant on the stability of the resistive films. If the resistive films should degrade over time, performance of the waveguide attenuator will be affected. Further, energy reflections and higher-order mode propagation commonly occur in such a waveguide attenuator design.

In another arrangement, a wedge shaped waveguide attenuator having resistive surfaces exists. Because the waveguide attenuator is wedge shaped, the E field again can be considered to split into two orthogonal components at each surface of the wedge, $E \sin \theta$ and $E \cos \theta$. As with the previous example, the $E \sin \theta$ component of a microwave signal is absorbed by the film. However, The tapered portion of the waveguide attenuator causes energy reflections to occur. Hence, the wedge shaped waveguide attenuator must be long enough to obtain sufficiently low reflection characteristics. Accordingly, this type of waveguide attenuator is limited to use in relatively long waveguides. Thus, a need exists for a waveguide attenuator that provides additional design flexibility and overcomes the limitations described above with respect to existing waveguide attenuators.

SUMMARY OF THE INVENTION

The present invention relates to a variable waveguide attenuator. The variable waveguide attenuator includes at least one waveguide attenuator cavity and a fluidic dielectric having a loss tangent, a permittivity and a permeability at least partially disposed within the waveguide attenuator cavity. At least one composition processor is included and adapted for changing a composition or a volume of the fluidic dielectric to vary the loss tangent, the permittivity and/or the permeability. A controller is provided for controlling the composition processor to selectively vary the volume, shape, loss tangent, the permittivity and/or the permeability in response to a waveguide attenuator control signal. In one arrangement, the permittivity and permeability can be varied concurrently.

The composition processor can selectively vary the volume and/or loss tangent to vary the attenuation of the continuously variable waveguide attenuator. The composition processor also can selectively vary the permeability and/or volume to maintain the characteristic impedance approximately constant when at least one of the loss tangent and the permittivity is varied. Further, the composition processor can selectively vary the permittivity and/or volume to maintain the characteristic impedance approximately constant when at least one of the loss tangent and the permeability is varied. Further, the permittivity and/or the permeability can be adjusted to adjust the characteristic impedance.

A plurality of component parts can be dynamically mixed together in the composition processor in response to the waveguide attenuator control signal to form the fluidic dielectric. The composition processor can include at least one proportional valve, at least one mixing pump, and at least one conduit for selectively mixing and communicating a plurality of the components of the fluidic dielectric from respective fluid reservoirs to a waveguide attenuator cavity. The composition processor can further include a component part separator adapted for separating the component parts of the fluidic dielectric for subsequent reuse.

The component parts can be selected from the group consisting of (a) a low permittivity, low permeability, low loss component, (b) a high permittivity, low permeability, low loss component, and (c) a high permittivity, high permeability, high loss component. In another arrangement, the component parts can be selected from the group consisting of (a) a low permittivity, low permeability, low loss component, (b) a high permittivity, low permeability, low loss component, (c) a high permittivity, high permeability, low loss component, and (d) a low permittivity, low permeability, high loss component. The fluidic dielectric can include an industrial solvent which can have a suspension of magnetic particles contained therein. The magnetic particles can consist of ferrite, metallic salts, and organo-metallic particles. In one arrangement, variable waveguide attenuator can contain about 50% to 90% magnetic particles by weight.

DETAILED DESCRIPTION OF THE PREFERRED EMBODIMENTS

The present invention provides the circuit designer with an added level of flexibility by permitting a fluidic dielectric to be used in a waveguide attenuator, thereby enabling attenuation and impedance characteristics of the waveguide attenuator to be varied. For example, either dielectric particles or fluids having a high loss tangent can be mixed into a fluid dielectric having a low to moderate loss tangent and the mixture ratio can be adjusted to vary the attenuation. Several high loss dielectric fluids exist. Examples are the Ferrotec EMG series, specifically EMG805, EMG807 and EMG1111. Examples of lossy particles include ferrite powder and cobalt powder, both available in micron-sized particles suitable for use in suspensions. Lossy fluids such as the aforementioned Ferrotec liquids would probably be a better choice as they are more likely to form a homogeneous mix as opposed to a particle suspension of Fe or Co. Further, the composition of the fluidic dielectric can be adjusted to change the impedance of the waveguide attenuator or to maintain a constant impedance as the particle density is adjusted. For example, the impedance of the waveguide attenuator can be precisely matched to the impedance of a waveguide by maintaining a constant ratio of $\in_r/\mu_r$, where $\in_r$ is the relative permittivity of the fluidic dielectric, and $\mu_r$ is the relative permeability of the fluidic dielectric. A precisely matched impedance can minimize energy reflections caused by a transition from an unattenuated portion of the waveguide to the waveguide attenuator. A precisely matched impedance also-reduces higher-order mode propagation. The volume and/or shape of the waveguide attenuator can also be adjusted using fluidics. In other words, a dielectric fluid can be used to alter the electrical size while a conductive fluid could be used alter the physical size or shape of the waveguide attenuator to provide tunable cut-off frequencies, attenuators, filters as well as mode control or suppression.

Figure 1:
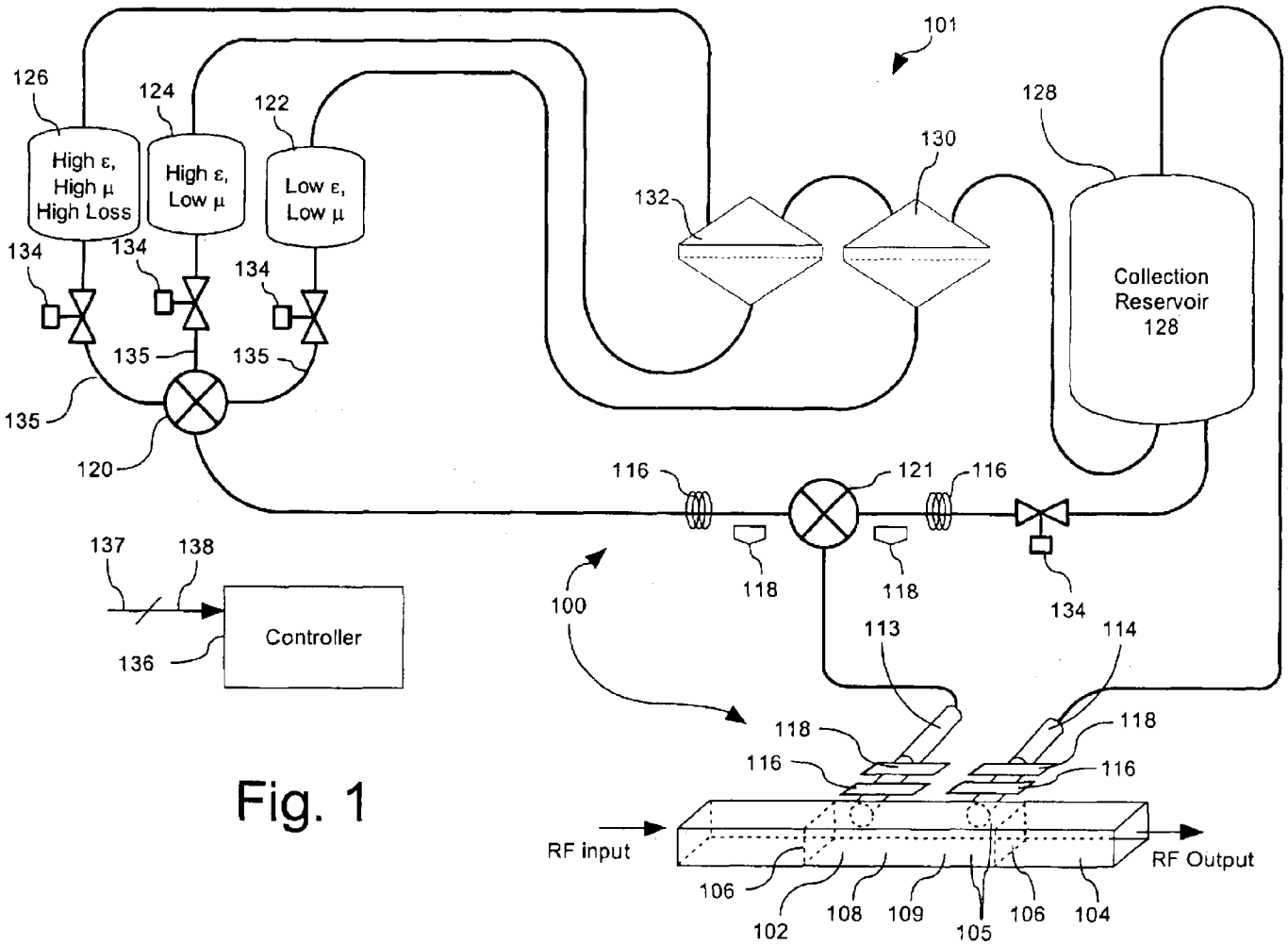
FIG. 1 is a block diagram useful for understanding the variable waveguide attenuator of the present invention.

FIG. 1 is a conceptual diagram that is useful for understanding the variable waveguide attenuator apparatus 100 of the present invention. The attenuator apparatus 100 can vary the characteristics of the waveguide attenuator 102, which comprises an attenuator cavity region 109 contained within a waveguide 104. The cavity region 109 is filled with a fluidic dielectric 108 to vary attenuation characteristics, permittivity and/or permeability of the waveguide attenuator 102 by either varying the composition or volume of fluidic dielectric within the cavity region 109. The waveguide 104 can be any structure capable of supporting propagation modes. Waveguides are commonly embodied as electrically conductive tubes having circular or rectangular cross sections, but the present invention is not so limited; the present invention can be incorporated into any type of waveguide having any desired shape. For example, the present invention can be incorporated into a waveguide comprising circuit traces on a dielectric substrate and a plurality of rows of conductive vias which cooperatively support propagation modes. In such an example, at least one cavity for containing fluidic dielectric can be positioned between adjacent rows of conductive vias. Additional vias having one end which couples to the cavity can be provided as a pathway for the flow of fluidic dielectric in and out of the cavity.

The waveguide attenuator 102 can be located anywhere within the waveguide 104. For example, the waveguide attenuator 102 can be located in a central location within the waveguide 104 at either end of the waveguide 104, or anywhere in between. Further, multiple waveguide attenuator cavities (see FIGS. 2 and 3) can be included in a single waveguide, for instance to provide an option of cascading waveguide filters within the waveguide 104. In one arrangement, successive cavities can be filled with dielectric fluid to achieve levels of attenuation higher than might be achieved by merely varying the fluidic dielectric in a single cavity. For example, a plurality of waveguide attenuator cavities each providing a range of attenuation levels of approximately 0–10 dB can be provided. Experimental data from a recent study found that in a coplanar waveguide transmission line structure (not to be confused with a conventional waveguide) the fluids provided an increased loss of between 2 and 20 dB of loss per inch of transmission line. Loss could be adjusted by both changes in the fluid as well as change in length of the waveguide section. If 18 dB of attenuation is needed, the attenuation of two waveguide filter cavities can be adjusted to be 9 dB. Alternatively, a first waveguide attenuator cavity can be adjusted to provide 10 dB of attenuation while the second waveguide attenuator cavity is adjusted to provide 8 dB of attenuation. Still, a myriad of combinations of waveguide filter cavities and attenuation levels can be used, any of which are within the scope of the present invention.

Although the shape of the waveguide attenuator 102 is primarily controlled by the shape of the cavity region 109, the waveguide attenuator 102 can incorporate other objects which protrude within the cavity 109. For example, tuning screws can protrude into the cavity region 109 to vary RF propagation characteristics within the cavity. Further, the cavity region 109 can comprise adjustable barriers and/or other objects which can change the RF response of the waveguide attenuator 102. Likewise, the control of volume within the cavity region 109 or regions can also alter the response of the waveguide attenuator. In particular, changing the dimensions and/or volume of fluid within the cavity region 109 can change the frequency of modes supported within cavity region 109.

Notably, the waveguide attenuator 102 can be provided in a variety of shapes. For example, the waveguide attenuator can be bounded on four sides by the walls 105 of the waveguide 104 and bounded on two sides by barriers 106. Preferably, the barriers are made of a dielectric material so as not to disrupt waveguide performance. In other arrangements the cavity 109 can be arranged in more complex shapes, for example a wedge shape.

Figure 3:
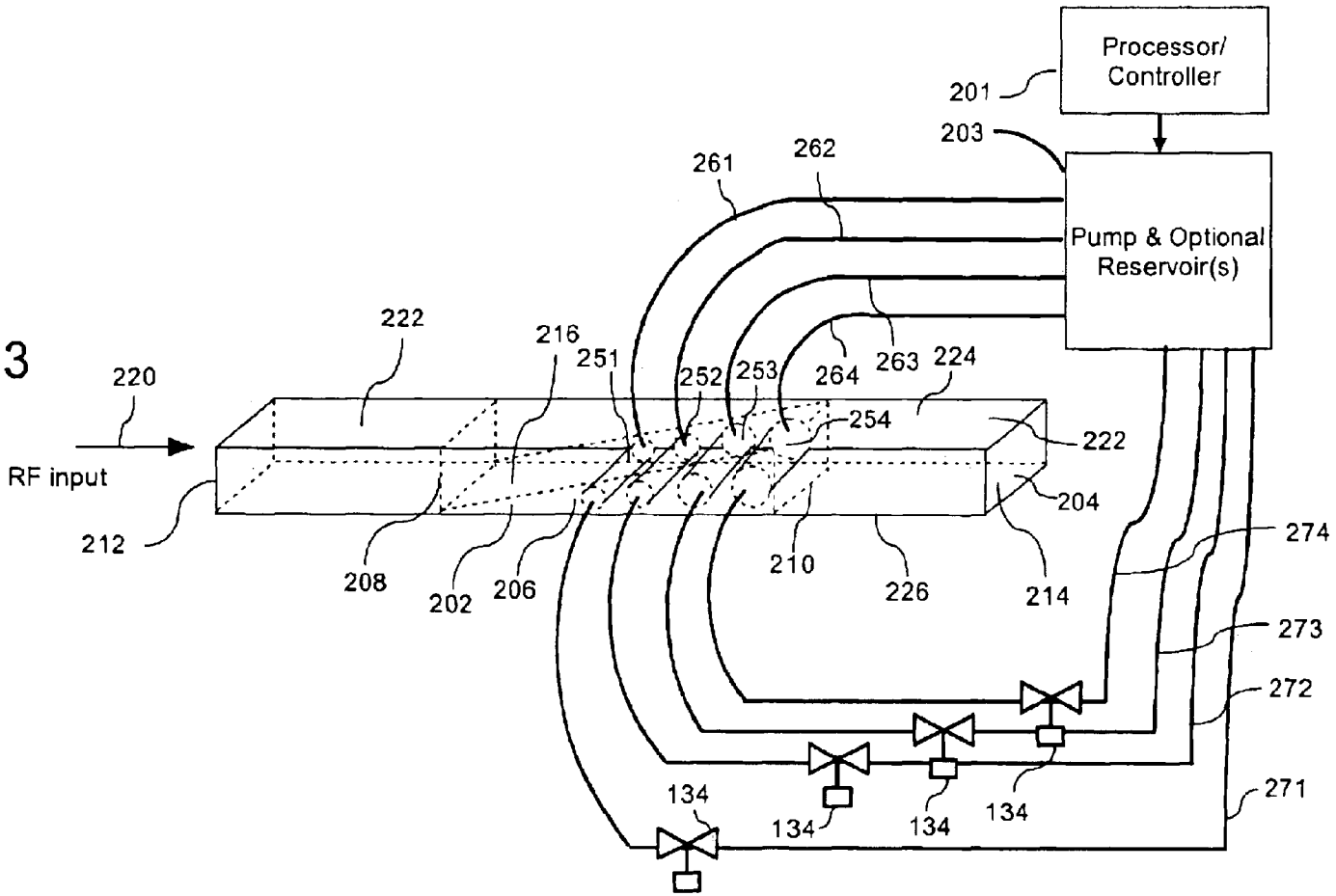
FIG. 3 is a block diagram of yet another variable waveguide attenuator having an alternate shape.

A wedge shape, as shown in FIG. 3, can be particularly useful to minimize reflection of an RF signal 220 due to the waveguide attenuator 202, for example, when there is an impedance mismatch between the waveguide attenuator 202 and the remaining dielectric 222 within a waveguide 204. Such an impedance mismatch can occur when the waveguide attenuator 202 has a different characteristic impedance than the remaining dielectric 222. The waveguide attenuator 202 can be positioned with a narrow end 208 oriented towards an end 212 of the waveguide 204 receiving RF input 220 and a wide end 210 of the waveguide attenuator 202 towards an output end 214 of the waveguide 204. Since there is a large angle of incidence between the RF signal 220 and a diagonal barrier 216, very little signal energy will be reflected towards the input end 212. Further, since the depth of the waveguide cavity 206 varies along the length of the waveguide attenuator 202, the amount of lossy fluidic dielectric existing within subcavities or chambers 251, 252, 253, and 254 between opposing waveguide walls 224 and 226 will vary. Accordingly, the attenuation of the waveguide attenuator 202 will vary over its' length. The change in attenuation should be taken into consideration when computing the overall net attenuation of the waveguide attenuator 202. A controller 201 containing look-up tables for controlling a pump 203 or multiple pumps as well as a reservoir or reservoirs in conjunction with valves 134 can shift volumes of fluidic dielectric to and from the subcavities or chambers via corresponding input conduits 261, 262, 263, and 264 and output conduits 271, 272, 273, and 274. Note that chambers or subcavities 251–254 vary in volume and that the present invention is not limited to a particular number of cavities. The greater the number of cavities in this regard the more "fine tuning" that will be available.

Referring again to FIG. 1, a composition processor 101 is provided for changing a composition or volume of the fluidic dielectric 108 to vary the attenuation characteristics of the fluidic dielectric. Further, it is preferable that the composition processor 101 also change the composition of the fluidic dielectric 108 to vary permittivity and/or permeability in order to maintain control over the characteristic impedance of the waveguide attenuator 102. A controller 136 controls the composition processor for selectively varying the attenuation, permittivity and/or permeability of the fluidic dielectric 108 in response to a waveguide attenuator control signal 137 on control input line 138. By selectively varying the attenuation, permittivity and/or permeability of the fluidic dielectric, the controller 136 can control attenuation of an RF signal, for example a microwave signal, through the waveguide 104 as well as group velocity of the RF signal. Further, the controller 136 can control the impedance of the waveguide 104 within the cavity region 109.

Composition of Fluidic Dielectric

The fluidic dielectric can be comprised of several component parts that can be mixed together to produce a desired attenuation, permittivity and permeability required for particular waveguide attenuator characteristics. In this regard, it will be readily appreciated that fluid miscibility and particle suspension are key considerations to ensure proper mixing. Another key consideration is the relative ease by which the component parts can be subsequently separated from one another. The ability to separate the component parts is important when the attenuation or impedance requirements change. Specifically, this feature ensures that the component parts can be subsequently re-mixed in a different proportion to form a new fluidic dielectric.

It may be desirable in many instances to select component mixtures that produce a fluidic dielectric that has a relatively constant response over a broad range of frequencies. If the fluidic dielectric is not relatively constant over a broad range of frequencies, the characteristics of the fluid at various frequencies can be accounted for when the fluidic dielectric is mixed. For example, a table of loss tangent, permittivity and permeability values vs. frequency can be stored in the controller 136 for reference during the mixing process.

Aside from the foregoing constraints, there are relatively few limits on the range of component parts that can be used to form the fluidic dielectric. Accordingly, those skilled in the art will recognize that the examples of component parts, mixing methods, volume distribution methods, and separation methods as shall be disclosed herein are merely by way of example and are not intended to limit in any way the scope of the invention. Also, the component materials are described herein as being mixed in order to produce the fluidic dielectric. However, it should be noted that the invention is not so limited. Instead, it should be recognized that the composition of the fluidic dielectric could be modified in other ways. For example, the component parts could be selected to chemically react with one another in such a way as to produce the fluidic dielectric with the desired values of permittivity and/or permeability. All such techniques will be understood to be included to the extent that it is stated that the composition or volume of the fluidic dielectric is changed.

A nominal value of permittivity ($\in_r$) for fluids is approximately 2.0. However, the component parts for the fluidic dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluidic dielectric with a permittivity anywhere within that range after mixing. Dielectric particle suspensions can also be used to increase permittivity and loss tangent.

According to a preferred embodiment, the component parts of the fluidic dielectric can be selected to include (a) a low permittivity, low permeability, low loss component and (b) a high permittivity, high permeability, high loss component. These two components can be mixed as needed for increasing the loss tangent while maintaining a relatively constant ratio of permittivity to permeability. A third component part of the fluidic dielectric can include (c) a high permittivity, low permeability, low loss component for allowing adjustment of the permittivity of the fluidic dielectric independent of the permeability. Still, a myriad of other component mixtures can be used. For example, the following fluidic dielectric components can be provided: (a) a low permittivity, low permeability, low loss component, (b) a high permittivity, low permeability, low loss component, (c) a high permittivity, high permeability low loss component, and (d) a low permittivity, low permeability, high loss component.

Several high loss dielectric fluids exist. Examples are the Ferrotec EMG series, specifically EMG805, EMG807 and EMG1111. Lossy fluids such as the aforementioned Ferrotec liquids would probably be a better choice as they are more likely to form a homogeneous mix as opposed to a particle suspension of Fe or Co.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a fluidic dielectric as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the fluidic dielectric, for example those commercially available from FerroTec Corporation of Nashua, N.H. 03060. In particular, Ferrotec part numbers EMG0805, EMG0807, and EMG1111 can be used. An example of a relatively low dielectric fluid with moderate to high loss is Lord MRF-132AD which exhibits a dielectric constant between 5 and 6 and a loss of approximately 5–6 times that of air. A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetoresrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

Processing of Fluidic Dielectric For Mixing/Unmixing of Components

The composition processor 101 can be comprised of a plurality of fluid reservoirs containing component parts of fluidic dielectric 108. These can include: a first fluid reservoir 122 for a low permittivity, low permeability component of the fluidic dielectric; a second fluid reservoir 124 for a high permittivity, low permeability component of the fluidic dielectric; a third fluid reservoir 126 for a high permittivity, high permeability, high loss component of the fluidic dielectric. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the fluidic dielectric and a fourth fluid reservoir can be provided to contain a component of the fluidic dielectric having a high loss tangent.

A cooperating set of proportional valves 134, mixing pumps 120, 121, and connecting conduits 135 can be provided as shown in FIG. 1 for selectively mixing and communicating the components of the fluidic dielectric 108 from the fluid reservoirs 122, 124, 126 to cavity 109. The composition processor also serves to separate out the component parts of fluidic dielectric 108 so that they can be subsequently re-used to form the fluidic dielectric with different attenuation, permittivity and/or permeability values. All of the various operating functions of the composition processor can be controlled by controller 136. The operation of the composition processor shall now be described in greater detail with reference to FIG. 1 and the flowchart shown in FIG. 4.

Figure 4:
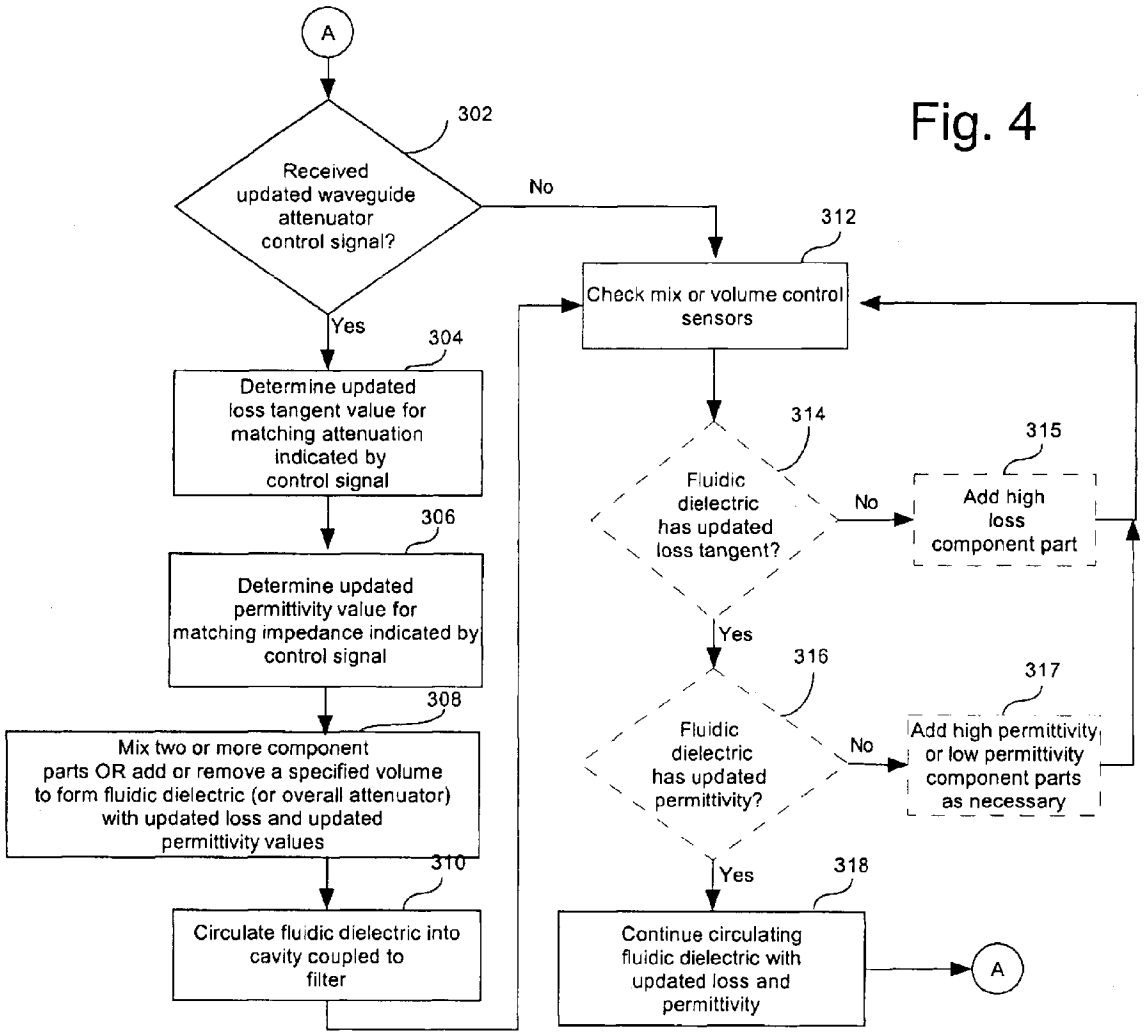
FIG. 4 is a flow chart that is useful for understanding the process of the invention.

The process can begin in step 302 of FIG. 4, with controller 136 checking to see if an updated waveguide attenuator control signal 137 has been received on an attenuator input line 138. If so, then the controller 136 continues on to step 304 to determine an updated loss tangent value for producing the attenuation indicated by the waveguide attenuator control signal 137. The updated loss tangent value necessary for achieving the indicated attenuation can be determined using a look-up table.

In step 306, the controller can determine an updated permittivity value for matching the characteristic impedance indicated by the waveguide attenuator control signal 137. For example, the controller 136 can determine the permeability of the fluidic components based upon the fluidic component mix ratios and determine an amount of permittivity that is necessary to achieve the indicated impedance for the determined permeability.

Referring to step 308, the controller 136 causes the composition processor 101 to begin mixing two or more component parts in a proportion to form fluidic dielectric that has the updated loss tangent and permittivity values determined earlier. Alternatively or in conjunction with mixing, the composition processor 101 can also begin altering specified volumes of fluidic dielectric to or from one or more cavities, subcavities or chambers within the waveguide attenuator to compensate for the previously determined updated values. In the case that the high loss component part also provides a substantial portion of the permeability in the fluidic dielectric, the permeability will be a function of the amount of high loss component part that is required to achieve a specific attenuation. However, in the case that a separate high permeability fluid is provided as a high permeability component part, the permeability can be determined independently of the loss tangent. This mixing process and/or volume shifting can be accomplished by any suitable means. For example, in FIG. 1 a set of proportional valves 134 and mixing pump 120 are used to mix component parts from reservoirs 122, 124, 126 appropriate to achieve the desired updated loss tangent, permittivity and permeability values.

In step 310, the controller causes the newly mixed fluidic dielectric 108 to be circulated into the cavity 109 through a second mixing pump 121 . In step 312, the controller checks one or more sensors 116, 118 to determine if the fluidic dielectric being circulated through the cavity 109 has the proper values of loss tangent, permittivity and permeability or to determine proper volumes corresponding to the previously determined updated values. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The loss tangent is the ratio at any particular frequency between the real and imaginary parts of the impedance, and the impedance can be determined from resistance (R), conductance (G), inductance (L) and capacitance (C) measurements. Additionally, loss tangent can be easily calculated using a separate resonator device, such as a dielectric ring resonator. Such cavity resonator devices are commonly used to compute the quality factor, Q, from which loss tangent is easily extracted. The sensors can be located as shown, at the input to mixing pump 121. Sensors 116, 118 are also preferably positioned to measure the loss tangent, permittivity and permeability of the fluidic dielectric passing through input conduit 113 and output conduit 114. Note that it is desirable to have a second set of sensors 116, 118 at or near the cavity 109 so that the controller can determine when the fluidic dielectric with updated loss tangent, permittivity and permeability values has completely replaced any previously used fluidic dielectric that may have been present in the cavity 109.

In a system based on mixtures rather then volumes of static compositions of fluid, step 314 optionally involves having the controller 136 comparing the measured loss tangent to the desired updated loss tangent value determined in step 304. If the fluidic dielectric does not have the proper updated loss tangent value, the controller 136 can cause additional amounts of high loss tangent component part to be added to the mix from reservoir 126, as shown in step 315.

If the fluidic dielectric is determined to have the proper level of loss in step 314, then the process continues on to optional step 316 where the measured permittivity from step 312 is compared to the desired updated permittivity value determined in step 306. If the updated permittivity value has not been achieved, then high or low permittivity component parts are added as necessary, as shown in step 317. The system can continue circulating the fluidic dielectric through the cavity 109 until both the loss tangent and permittivity passing into and out of the cavity 109 (or the volume of a specific fluidic dielectric) are the proper value, as shown in step 318. Once the loss tangent and permittivity are the proper value, the process can continue to step 302 to wait for the next updated waveguide attenuator control signal.

Significantly, when updated fluidic dielectric is required, any existing fluidic dielectric must be circulated out of the cavity 109. Any existing fluidic dielectric not having the proper loss tangent and/or permittivity can be deposited in a collection reservoir 128. The fluidic dielectric deposited in the collection reservoir can thereafter be re-used directly as a fourth fluid by mixing with the first, second and third fluids or separated out into its component parts so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir.

Those skilled in the art will recognize that the specific process used to separate the component parts from one another will depend largely upon the properties of materials that are selected and the invention. Accordingly, the invention is not intended to be limited to the particular process outlined above.

Figure 2:
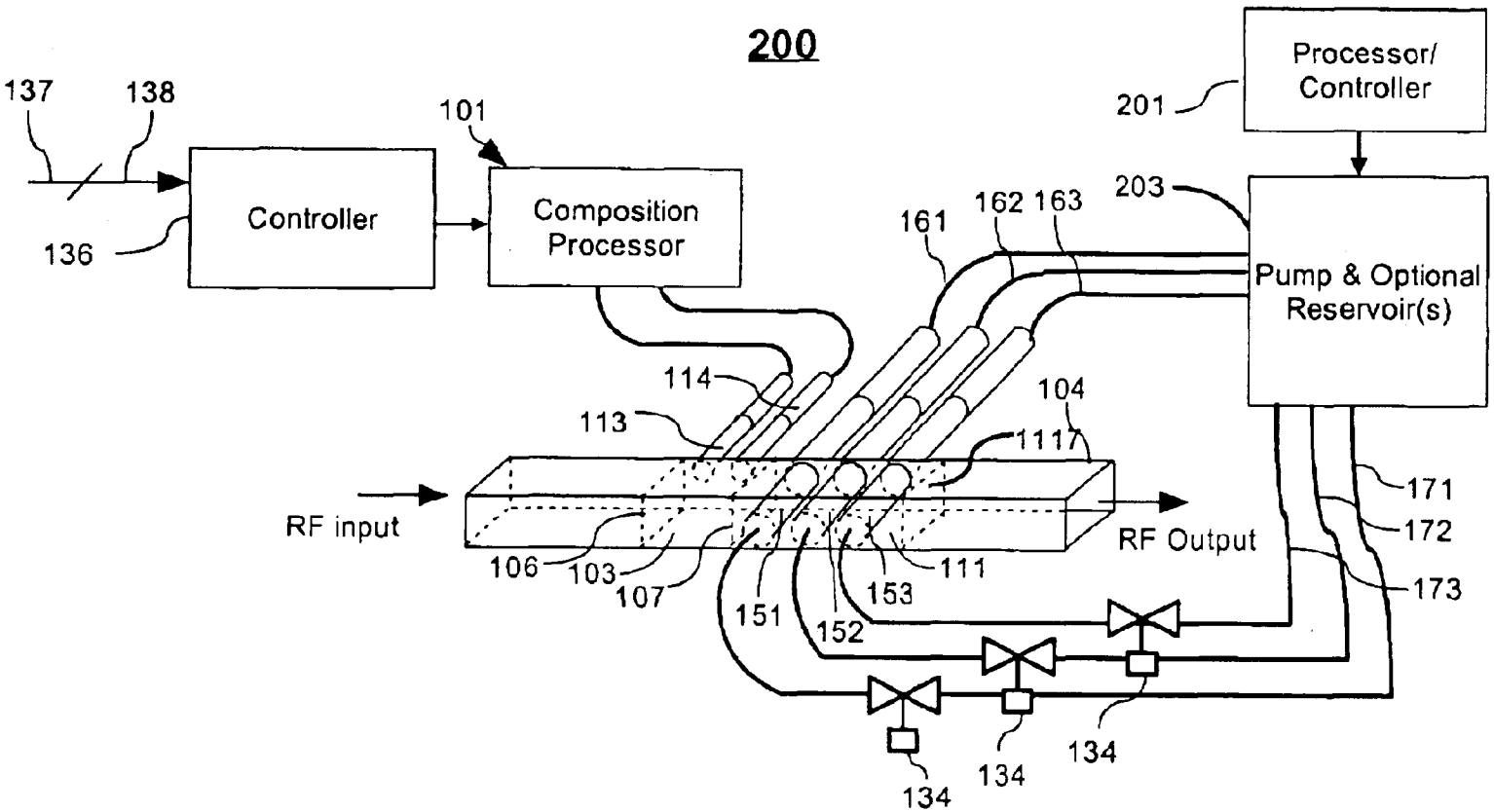
FIG. 2 is a block diagram of another variable waveguide attenuator in accordance with the present invention.

The embodiments of FIGS. 2 and 3 illustrate alternative embodiments. A waveguide attenuator apparatus 200 of FIG. 2 in particular illustrates a single system using both mixture or composition control as well volume control. In this instance, a similar controller 136 and composition processor 101 as described with respect to FIG. 1 controls the composition of fluidic dielectric in a waveguide attenuator region 103 of waveguide 104. Control signal 137 on control input line 138 controls the mixture and/or volume of fluidic dielectric via input conduit 113 and output conduit 114 within the chamber or cavity defined between walls 106 and 107. Likewise, another waveguide attenuator region 111 defined between walls 107 and 117 includes a plurality of chambers or subcavities 151, 152, and 153. Preferably, these cavities can be a plurality of capillary tubes having a plurality of corresponding input conduits 161, 162 and 162 feeding fluidic dielectric to the cavities and a plurality of output conduits 171, 172, and 173 providing a means for removing fluidic dielectric from the cavities. The volume control of the fluidic dielectric through the cavities, subcavities or chambers can be achieved cooperatively using a series of valves 134, a controller 201 for controlling a pump 203 (or pumps) and optional reservoir or reservoirs as shown.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A variable waveguide attenuator, comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing an electrical characteristic and a physical characteristic of the variable waveguide attenuator by manipulating said fluidic dielectric to selectively vary at least one parameter selected from the group consisting of a volume and a shape, and to selectively vary at least one parameter selected from the group consisting of said loss tangent, said permittivity and said permeability of the fluidic dielectric; and a controller for controlling said composition processor in response to a waveguide attenuator control signal.

2. The variable waveguide attenuator according to claim 1, further comprising a second waveguide attenuator cavity.

3. The variable waveguide attenuator according to claim 2, wherein said second waveguide attenuator cavity is at least partially filled with a second fluidic dielectric.

4. The variable waveguide attenuator according to claim 3, further comprising at least a second composition processor adapted for dynamically changing a composition of said second fluidic dielectric to vary at least one parameter selected from the group consisting of a volume, a loss tangent, a permittivity and a permeability of said second fluidic dielectric.

5. The variable waveguide attenuator according to claim 1 wherein said fluidic dielectric is comprised of an industrial solvent.

6. The variable waveguide attenuator according to claim 5 wherein said industrial solvent has a suspension of magnetic particles contained therein.

7. The variable waveguide attenuator according to claim 6 wherein said magnetic particles are formed of a material selected from the group consisting of ferrite, metallic salts, and organo-metallic particles.

8. The variable waveguide attenuator according to claim 6 wherein said component contains between about 50% to 90% magnetic particles by weight.

9. A variable waveguide attenuator comprising:

at least one waveguide attenuator cavity;

a fluidic dielectric at least partially diseased within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least two parameters selected from the group consisting of a volume, said loss tangent, said permittivity and said permeability of the fluidic dielectric;

a controller for controlling said composition processor in response to a waveguide attenuator control signal;

wherein said composition processor selectively varies concurrently said two parameters within the at least one subcavity in response to said waveguide attenuator control signal.

10. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluid dielectric;

a controller for controlling said composition processor in response to a waveguide attenuator control signal;

wherein the waveguide attenuator has an attenuation and said composition processor selectively varies said loss tangent to vary said attenuation.

11. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein the waveguide attenuator has an attenuation and said composition processor selectively varies said loss tangent to maintain said attenuation constant as at least one of said permittivity and said permeability is varied.

12. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein the waveguide attenuator has a characteristic impedance and said composition processor selectively varies said permeability to maintain said characteristic impedance approximately constant when at least one parameter selected from the group consisting of said loss tangent, said permittivity, and said volume is varied.

13. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein the waveguide attenuator has a characteristic impedance and said composition processor selectively varies said permeability to adjust said characteristic impedance.

14. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein the waveguide attenuator has a characteristic impedance and said composition processor selectively varies said permittivity to maintain said characteristic impedance approximately constant when at least one parameter selected from the group consisting of said loss tangent, said permeability and said volume is varied.

15. A variable waveguide attenuator comprising:

at least one waveguide attenuator cavity;

a fluidic dielectric at least disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein the waveguide attenuator has a characteristic impedance and said composition processor selectively varies said permittivity to adjust said characteristic impedance.

16. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein a plurality of component parts are dynamically mixed together in said composition processor responsive to said waveguide attenuator control signal to form said fluidic dielectric.

17. The variable waveguide attenuator according to claim 16 wherein said composition processor further comprises a component part separator adapted for separating said component parts of said fluidic dielectric for subsequent reuse.

18. A variable waveguide attenuator comprising:

at least one waveguide attenuator cavity;

a fluidic dielectric at least partially disposed within at least one subcavity within said waveguide attenuator cavity, said fluidic dielectric having a loss tangent, a permittivity and a permeability;

at least one composition processor adapted for changing at least one characteristic of the variable waveguide attenuator selected from the group consisting of an electrical characteristic and a physical characteristic by manipulating said fluidic dielectric to vary at least one parameter selected from the group consisting of a volume, said loss tangent, said permittivity and said permeability of the fluidic dielectric;

a controller for controlling said composition processor in response to a waveguide attenuator control signal;

wherein said composition processor further comprises at least one proportional valve, at least one mixing pump, and at least one conduit for selectively mixing and communicating a plurality of said components of said fluidic dielectric from respective fluid reservoirs to said waveguide attenuator cavity.

19. A method for attenuating an RF signal comprising the steps of:

providing at least one waveguide attenuator cavity within a waveguide;

at least partially filling said waveguide attenuator cavity with a fluidic dielectric;

propagating said RF signal within said waveguide; and responsive to a waveguide attenuator control signal, dynamically changing at an electrical characteristic and a physical characteristic of the waveguide by manipulating said fluidic dielectric to selectively vary at least one parameter selected from the group consisting of a volume and a shape, and to selectively vary at least one parameter selected from the group consisting of a loss tangent, a permittivity and a permeability of said fluidic dielectric.

20. The method according to claim 19 further comprising the step of selectively varying said permittivity to adjust a characteristic impedance of said waveguide.

21. The method according to claim 19 further comprising the step of varying said loss tangent to vary said attenuation.

22. The method according to claim 19 further comprising the step of selectively varying said permittivity to maintain a characteristic impedance of said waveguide approximately constant when at least one parameter selected from the group consisting of said loss tangent and said permeability is varied.

23. The method according to claim 19 further comprising the step of selectively varying said permeability to maintain a characteristic impedance of said waveguide approximately constant when at least one parameter selected from the group consisting of said loss tangent and said permittivity is varied.

24. The method according to claim 19 further comprising the step of selectively varying said permeability to adjust a characteristic impedance of said waveguide.

25. The method according to claim 19, further comprising the step of providing a second waveguide attenuator cavity.

26. The method according to claim 25, further comprising the step of at least partially filling said second waveguide attenuator cavity with a second fluidic dielectric.

27. The method according to claim 26, further comprising the step of providing at least a second composition processor adapted for dynamically changing a composition of said second fluidic dielectric to vary at least one parameter selected from the group consisting of a loss tangent, a permittivity and a permeability of said second fluidic dielectric.

28. The method according to claim 19 further comprising the step of dynamically mixing a plurality of components in response to said waveguide attenuator control signal to produce said fluidic dielectric.

29. The method according to claim 28 further comprising the steps of selectively mixing said components of said fluidic dielectric from respective fluid reservoirs.

30. The method according to claim 28 further comprising the step of separating said fluidic dielectric into said components for subsequent reuse in forming said fluidic dielectric.

31. A method for attenuating an RF signal comprising the steps of:

providing at least one waveguide filter cavity within a waveguide;

at least partially filling said waveguide filter cavity with a fluidic dielectric;

propagating said RF signal within said waveguide; and responsive to a waveguide attenuator control signal, dynamically changing at least one characteristic selected from the group consisting of a volume and a composition of said fluidic dielectric to concurrently selectively vary at least two parameters of the fluidic dielectric selected from the group consisting of a loss tangent, a permittivity and a permeability.

32. A method for attenuating an RF signal comprising the steps of:

providing at least one waveguide filter cavity within a waveguide;

at least partially filling said waveguide filter cavity with a fluidic dielectric;

propagating said RF signal within said waveguide;

responsive to a waveguide attenuator control signal, varying said loss tangent to maintain said attenuation constant as at least one parameter selected from the group consisting of said permittivity and said permeability is varied.

* * * * *

UNITED STATES PATENT AND TRADEMARK OFFICE

CERTIFICATE OF CORRECTION

PATENT NO. : 6,952,146 B2
APPLICATION NO. : 10/624378
DATED : October 4, 2005
INVENTOR(S) : Brown et al.

It is certified that error appears in the above-identified patent and that said Letters Patent is hereby corrected as shown below:

Column 11
Line 32, delete “diseased” and replace with --disposed--.

Column 14
Line 33, delete “at” after “changing.”

Signed and Sealed this

Thirty-first Day of October, 2006

JON W. DUDAS
*Director of the United States Patent and Trademark Office*